US009850718B2

(12) United States Patent
Mueller et al.

(10) Patent No.: US 9,850,718 B2
(45) Date of Patent: Dec. 26, 2017

(54) RETENTION DEVICE FOR DRILL PIPE TRANSMISSION LINE

(71) Applicants: Stephan Mueller, Hannover (DE); Ingo Roders, Celle (DE); Robert Buda, Lower Saxony (DE); Rene Schulz, Lower Saxony (DE); Henning Rahn, Celle (DE); Detlev Benedict, Celle (DE)

(72) Inventors: Stephan Mueller, Hannover (DE); Ingo Roders, Celle (DE); Robert Buda, Lower Saxony (DE); Rene Schulz, Lower Saxony (DE); Henning Rahn, Celle (DE); Detlev Benedict, Celle (DE)

(73) Assignee: BAKER HUGHES, A GE COMPANY LLC, Houston, TX (US)

( * ) Notice: Subject to any disclaimer, the term of this patent is extended or adjusted under 35 U.S.C. 154(b) by 866 days.

(21) Appl. No.: 13/961,227

(22) Filed: Aug. 7, 2013

(65) Prior Publication Data

US 2015/0041214 A1 Feb. 12, 2015

(51) Int. Cl.

| | |
|---|---|
| ***E21B 47/12*** | (2012.01) |
| ***E21B 17/00*** | (2006.01) |
| ***E21B 17/02*** | (2006.01) |

(52) U.S. Cl.

CPC ..... *E21B 17/003* (2013.01); *E21B 17/02* (2013.01); *E21B 17/023* (2013.01); *E21B 17/028* (2013.01); *E21B 47/12* (2013.01); *E21B 47/122* (2013.01)

(58) Field of Classification Search

CPC ..... E21B 17/003; E21B 17/023; E21B 17/028

See application file for complete search history.

(56) References Cited

U.S. PATENT DOCUMENTS

| | | | |
|---|---|---|---|
| 6,830,467 | B2 | 12/2004 | Hall et al. |
| 6,982,384 | B2 | 1/2006 | Hall et al. |
| 7,299,867 | B2 | 11/2007 | Hall et al. |
| 7,527,105 | B2 | 5/2009 | Hall et al. |

(Continued)

FOREIGN PATENT DOCUMENTS

| | | | |
|---|---|---|---|
| EP | 2236736 | A1 | 10/2010 |
| WO | 2013053449 | A2 | 4/2013 |

OTHER PUBLICATIONS

Notification of Transmittal of the International Search Report and the Written Opinion of the International Searching Authority; PCT/US2014/049348; Korean Intellectual Property Office; dated Nov. 27, 2014; 10 pages. Authority;.

*Primary Examiner* — Nicole Coy
*Assistant Examiner* — Tara E Schimpf
(74) *Attorney, Agent, or Firm* — Cantor Colburn LLP

(57) ABSTRACT

An apparatus for communicating a signal to or from a downhole tool includes a drill pipe configured to be rotated to drill a borehole, a tubular under axial tension and secured in the drill pipe, and a retention device secured to the tubular and configured to maintain the tubular under the axial tension. The retention device includes a portion extending from a body of the device in a direction that is non-inward-radial with respect to a longitudinal axis of the drill pipe. The apparatus further includes a transmission line disposed in the tubular and in an opening of the retention device and in communication with the downhole tool.

16 Claims, 9 Drawing Sheets

(56) References Cited

U.S. PATENT DOCUMENTS

| | | | | |
|---|---|---|---|---|
| 8,118,093 | B2 | 2/2012 | Hassell et al. | |
| 2004/0149471 | A1* | 8/2004 | Hall | E21B 17/003 174/21 R |
| 2005/0001736 | A1* | 1/2005 | Hall | E21B 17/023 340/854.1 |
| 2005/0045339 | A1* | 3/2005 | Hall | E21B 31/107 166/380 |
| 2007/0056723 | A1* | 3/2007 | Hall | E21B 17/028 166/65.1 |
| 2010/0111592 | A1* | 5/2010 | Hassell | E21B 17/023 403/24 |
| 2011/0095485 | A1 | 4/2011 | Saylor, III et al. | |
| 2012/0274477 | A1 | 11/2012 | Prammer | |

* cited by examiner

RETENTION DEVICE FOR DRILL PIPE TRANSMISSION LINE

BACKGROUND

Geologic reservoirs may be used for various purposes such as hydrocarbon production, geothermal production, or carbon dioxide sequestration. These reservoirs are typically accessed by drilling boreholes through the earth to the reservoirs.

A borehole is drilled using a drill bit that is rotated by drill pipes coupled together in series and generally known as a drill string. As the borehole is being drilled, several instruments or tools disposed at the drill string may perform measurements that may be used to monitor drilling operations or characterize the earth formation being drilled. In order to provide these measurements to an operator, processing system or controller disposed at the surface of the earth in real time, these measurements may be transmitted electrically via a transmission line or cable disposed in the drill string. Because drilling fluid is pumped through the interior of the drill string and the drill string is subject to severe vibrations during the drilling process, apparatus and method that protects the transmission line would be well received in the drilling industry.

BRIEF SUMMARY

Disclosed is an apparatus for communicating a signal to or from a downhole tool. The apparatus includes: a drill pipe configured to be rotated to drill a borehole; a tubular under axial tension and secured in the drill pipe; a retention device secured to the tubular and configured to maintain the tubular under the axial tension, the retention device comprising a portion extending from a body of the device in a direction that is non-inward-radial with respect to the drill pipe; and a transmission line disposed in the tubular and in an opening of the retention device and in communication with the downhole tool.

Also disclosed is a method for building an apparatus for communicating a signal to or from a downhole tool. The method includes: receiving a drill pipe; placing a tubular in axial tension; securing the tubular to the drill pipe using a retention device configured to maintain the tubular under the axial tension, the retention device having a portion extending from a body of the device in a direction that is non-inward-radial with respect to the drill pipe; disposing a transmission line into the tubular and an opening of the retention device; wherein the transmission line is configured to communicate the signal.

Further disclosed is a method for communicating a signal to or from a downhole tool. The method includes: disposing a drill pipe in a borehole; and communicating the signal to or from the downhole tool using a transmission line in communication with the downhole tool, the transmission line being disposed in a tubular that is under axial tension and in a retention device that secures the tubular to the drill pipe, the retention device having a portion extending from a body of the device in a direction that is non-inward-radial with respect to the drill pipe.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed are apparatus and method for retaining a tubular disposed in a drill pipe that is part of a drill string. The tubular is configured to enclose or form part of a transmission line in order to retain the transmission line and protect it from vibrations and the environment interior to the drill string. The drill tubular is secured to the drill pipe under tension using a retainer device secured to each end of the drill pipe. The tension provides additional rigidity to the tubular to limit movement preventing interference with tools that may traverse the interior of the drill string.

Figure 1:
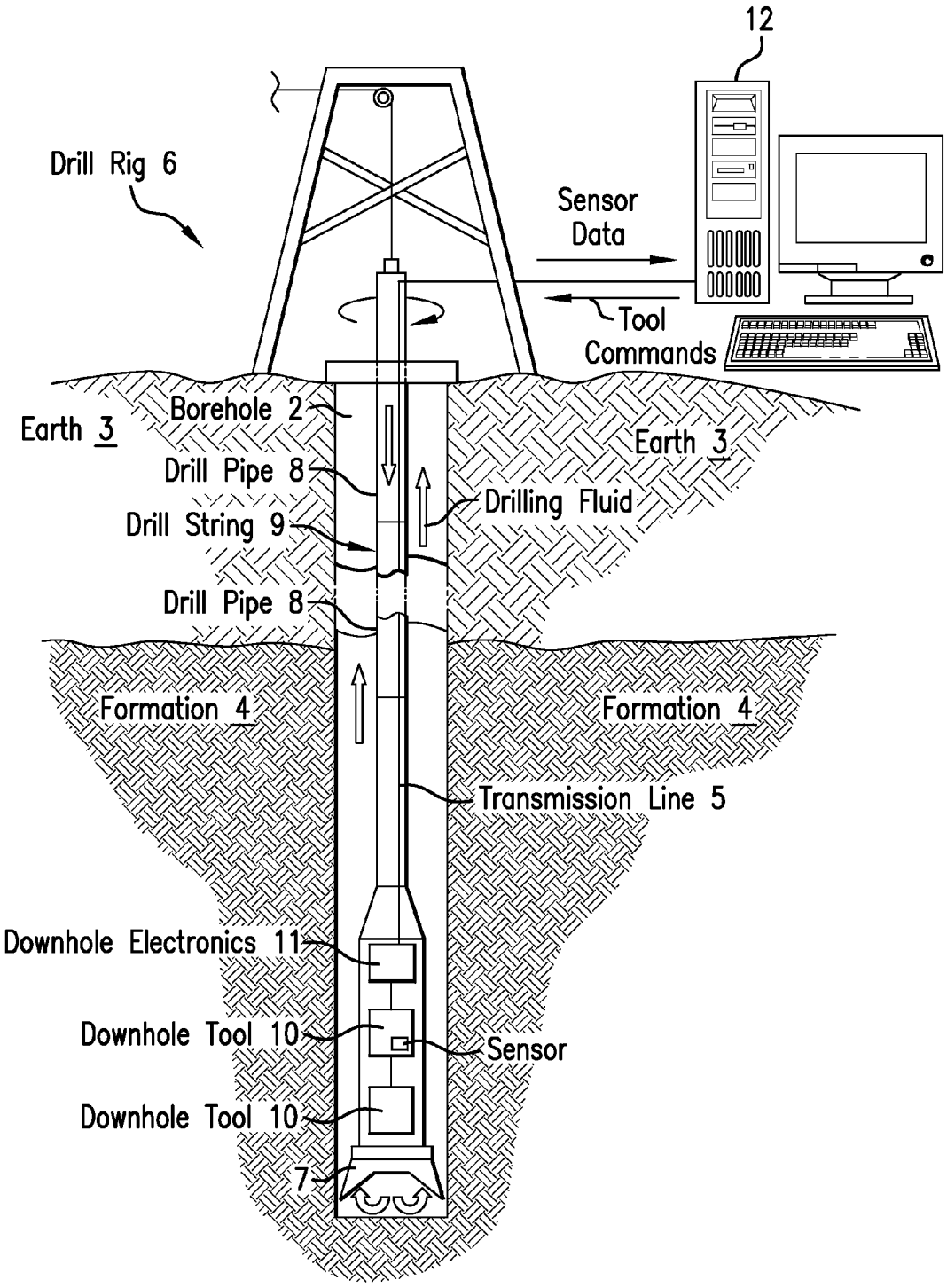
FIG. 1 illustrates a cross-sectional view of an exemplary embodiment of a drill string disposed in a borehole penetrating the earth.

FIG. 1 illustrates a cross-sectional view of an exemplary embodiment of a drill string 9 disposed in a borehole 2 penetrating the earth 3, which may include an earth formation 4. The drill string 9 is made up of a series of drill pipes 8 that are coupled together. A drill bit 7 is disposed at the distal end of the drill string 9. A drill rig 6 is configured to conduct drilling operations such as rotating the drill string 9 and thus the drill bit 7 in order to drill the borehole 2. In addition, the drill rig 6 is configured to pump drilling fluid through the interior of the drill string 9 in order to lubricate the drill bit 7 and flush cuttings from the borehole 2. Downhole tools 10 are disposed at (i.e., in or on) the drill string 9. The downhole tools 10 are configured to perform measurements related to monitoring drilling operations and/or characterizing the earth formation 4. Accordingly, the downhole tools may include a sensor. The downhole tools 10 may also be configured to perform mechanical actions such as retrieving a formation fluid sample. Downhole electronics 11 are coupled to the downhole tools 10. The downhole electronics 11 are configured to operate the downhole tools 10, process measurement data obtained downhole, and/or act as an interface with telemetry to communicate data or commands between the downhole tools 10 and a computer processing system 12 disposed at the surface of the earth 3. The telemetry includes a transmission line 5 disposed in each drill pipe 8. Electrical communication signals are communicated between the drill pipes 8 using cooperative signal couplers that may be recessed at mating surfaces or shoulders of adjoining drill pipes. System operation and data processing operations may be performed by the downhole electronics 11, the computer processing system 12, or a combination thereof. The downhole tools 10 may be operated continuously or at selected depths, depth intervals, times, or time intervals in the borehole 2.

It can be appreciated that the transmission line 5 may be configured to convey electrical signals, electromagnetic signals or optical signals. To convey electrical signals, the transmission line 5 may include two or more electrical conductors, and the cooperative signal couplers may be induction coils, which can induce a signal from one coil to a cooperative adjacent coil using electromagnetic induction. It can be appreciated that other types of technology may be employed to transmit electrical signals between adjacent drill pipes. The other types of technology may include capacitive (resonant electric) coupling, optical coupling, galvanic coupling (e.g. electrical connection), and a resonant coupling system that may use acoustic resonators for converting the electrical signals to acoustic signals and vice-versa. Non-limiting embodiments of the transmission line 5 for communicating electrical signals include a coaxial cable, a triaxial cable, a twisted pair cable, a ribbon cable, and insulated conductors. To convey electromagnetic signals, the transmission line 5 may be a wave guide and may include the tubular 20 itself and the cooperative signal couplers may be configured to couple wave guides. To convey optical signals, the transmission line 5 may include one or more optical fibers and the cooperative signal couplers may be optical couplers having optical mating surfaces that may be recessed in the drill pipe mating surfaces.

Figure 2:
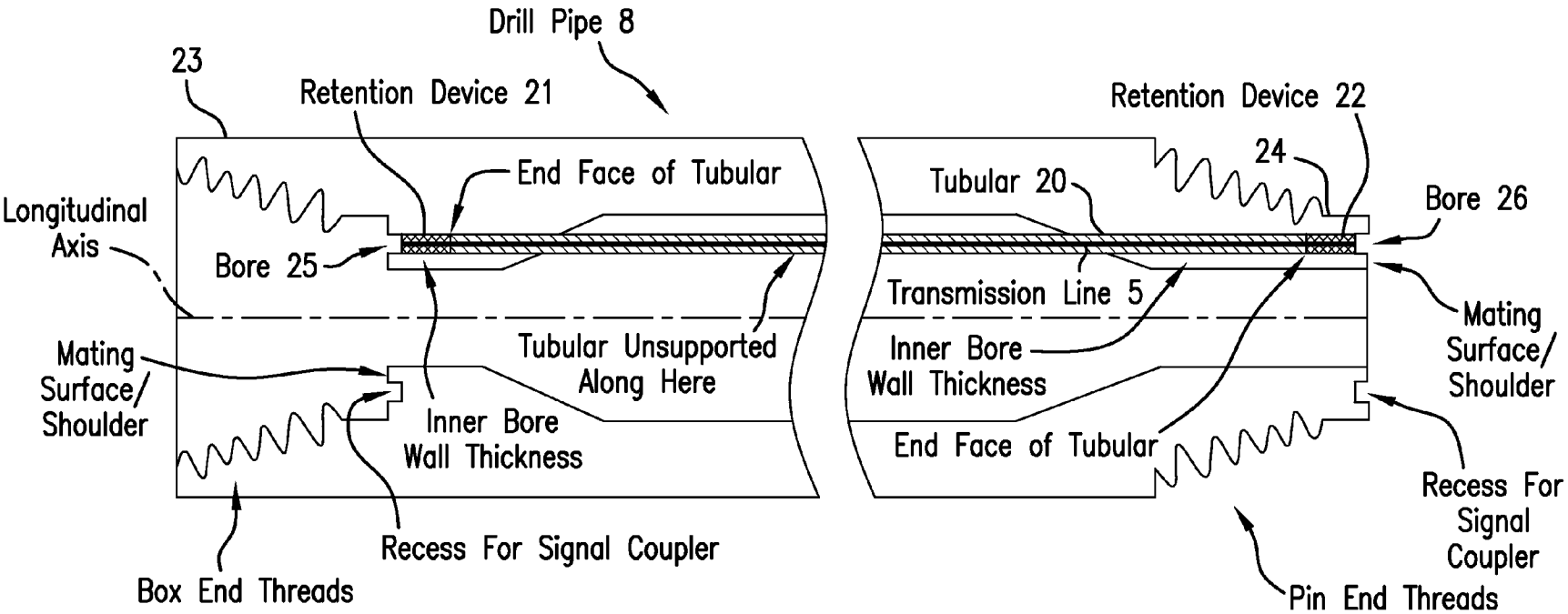
FIG. 2 depicts aspects of retention devices for a tubular in a drill pipe that is in the drill string.

Reference may now be made to FIG. 2 depicting aspects of one drill pipe 8 in a cross-sectional view. The drill pipe 8 in FIG. 2 is labeled as having a box end 23 and a pin end 24. Each end of the drill pipe 8 is configured to couple to an adjacent drill pipe 8 in the drill string 9 or to a downhole tool. In the embodiment of FIG. 2, the box end 23 has a box end thread configuration and the pin end 24 has a pin end thread configuration. A tubular 20 is disposed within the drill pipe 8 between the mating surfaces of box end 23 and the pin end 24. The tubular 20 is configured to contain the transmission line 5 or to be part of the transmission line 5. It can be appreciated that in one or more embodiments, the term "transmission line" may be inclusive of the tubular 20. That is, reference to the "transmission line" may inherently include the tubular 20 such as when the signal conducting medium and the tubular 20 are provided as an assembly. By containing the transmission line 5, the tubular 20 provides protection from the drilling fluid flowing within the drill pipe 8 and limits the range of movement of the transmission line 5 due to drill string vibration. By limiting the range of movement, the tubular 20 may prevent cracks or damage from occurring in the transmission line 5 due to repetitive movement in response to drill string vibrations.

In the embodiment of FIG. 2, the tubular 20 is disposed in the bores 25 and 26 at the ends 23 and 24, respectively. The tubular 20 traverses the interior of the drill pipe 8 between the bores 25 and 26 unsupported or restrained for a range of distances.

In an installed configuration, the tubular 20 is under axial tension (i.e. having at least a vector component of axial tension), which can improve the rigidity and resistance to flexing of the tubular 20. In one or more embodiments, a first retention device 21 may be secured to a first end face of the tubular 20. The tubular 20 is then stretched a selected amount that is within the desired deformation range (which may be elastic) of the tubular 20 and a second retention device 22 may be secured to a second end face of the tubular 20. The term "end face" as used with respect to the tubular 20 refers to where the tubular 20 terminates or ends. The tubular 20 with the second retention device 22 installed is allowed to retract into the drill pipe 8, but still remains under axial tension after retraction. Hence, the tubular 20 remains under axial tension even when the drill pipe 8 is in an unstressed state such as not being under axial tension from a drilling operation. It can be appreciated that the amount of axial tension may be sufficient to keep the tubular under axial tension even when the drill pipe is undergoing compressive loads during drilling operations.

It can be appreciated that increasing the amount of stretching may increase the amount of rigidity and resistance to flexing and, thus, prevent cracks or damage from occurring in the tubular 20. In addition, by resisting flexing the tubular 20 may be held firmly in place so as not to interfere with tools that may be conveyed through the interior or the drill string 9. It can be appreciated that increasing the amount of stretching, but still being within the elastic deformation range, may increase the natural resonant frequency of the tubular 20 such that the resonant frequency has sufficient distanced to a drill string's vibrational frequency under all environmental conditions (e.g., temperature ranges, pressure ranges, mud properties) to which the drill string will be exposed. In one or more embodiments, the tubular 20 is made from a high strength metal alloy such as a high strength stainless steel alloy. Similarly, in one or more embodiments, the retention devices 21 and 22 are made from a high strength metal alloy such as a high strength stainless steel alloy. Materials selected for the tubular 20 and the retention devices 21 and 22 are in general suitable to be welded or attached to each other. The term "high strength" relates to the metal alloy having a high enough strength to be resistant to damage during normal use. The pre-tension of the tubular is selected such that the tubular 20 is usually tensioned during drill pipe use such as when the drill pipe is in a curved borehole or undergoing compression. It can be appreciated that high strength composite materials may also be used to build the tubular 20 and the retention devices 21 and 22.

Figure 3:
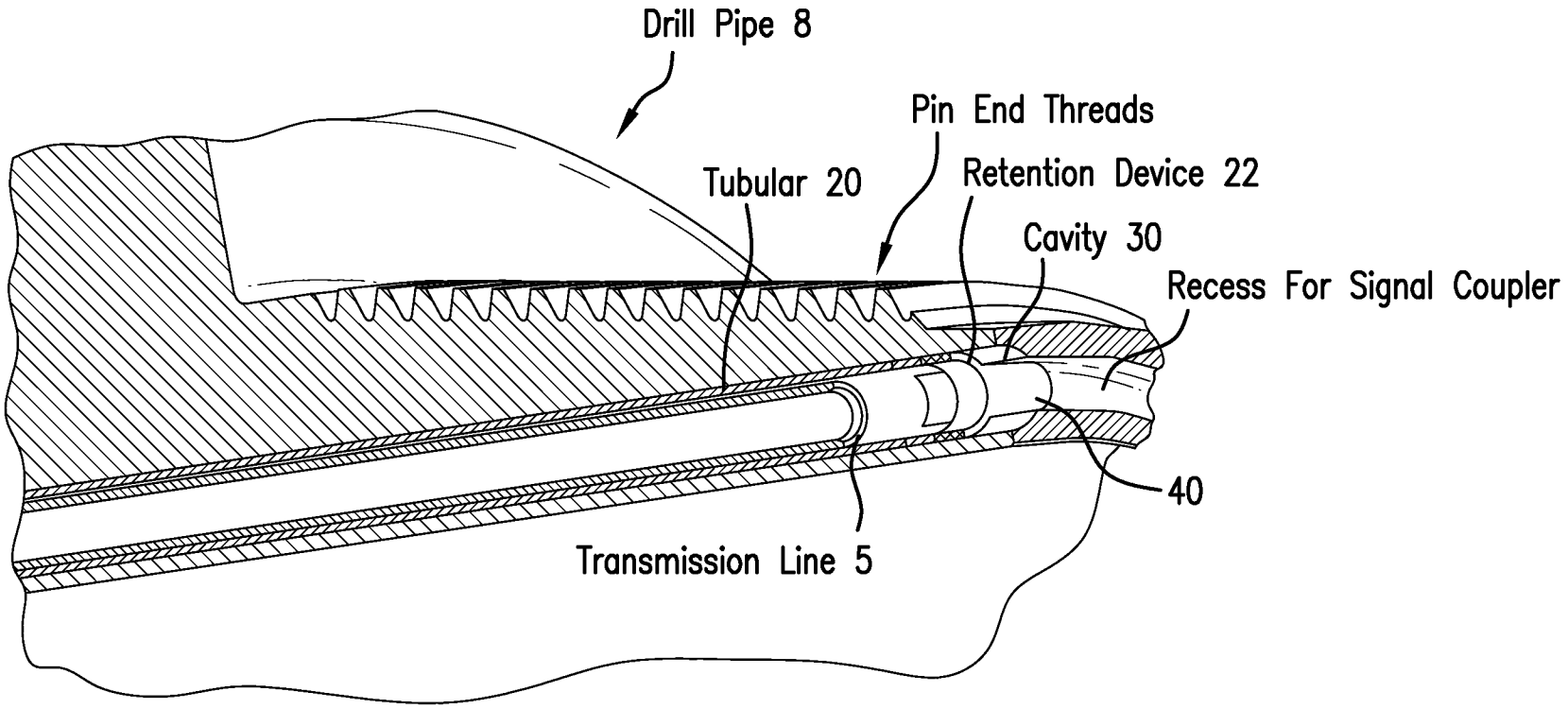
FIG. 3 depicts aspects of one retention device securing the tubular to a pin end of the drill pipe.
Figure 4A:
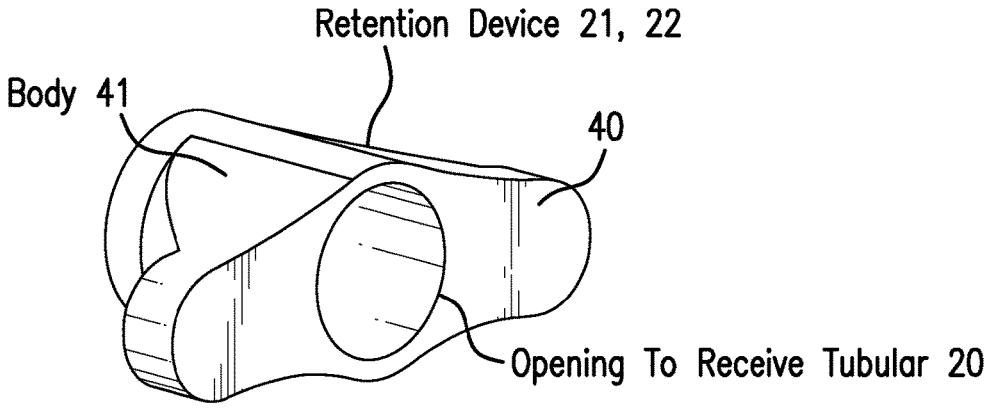
FIGS. 4A and 4B, collectively referred to as FIG. 4, depict aspects of a retention device having a T-shape.
Figure 4B:
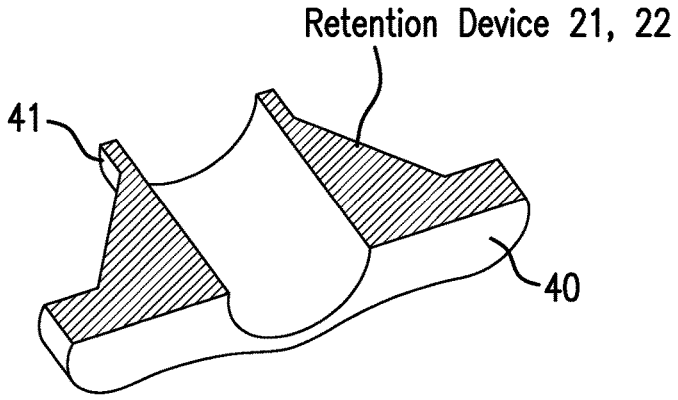

FIG. 3 illustrates a three-dimensional end view of the pin end of the drill pipe 8 with the tubular 20 installed using the second retention device 22. The transmission line 5, the tubular 20 and the second retention device 22 are shown in a cut-view. FIG. 4 illustrates a three-dimensional view of one embodiment of the second retention device 22, which may be the same as the first retention device 21. As illustrated in FIG. 4A, the retention device 21, 22 includes a T-shaped portion 40 that extends from a body 41 and has a dimension that exceeds the diameter of the bore that accepts the tubular 20 in the drill pipe 8. The T-shaped portion 40 presses against the drill pipe 8 to keep the tubular 20 in axial tension. FIG. 4B illustrates a three-dimensional cut view of the retention device 21, 22. An advantage of the T-shape is that the arms of the "T" can be positioned so that they do not extend into the flow path of the drilling fluid and yet still provide enough material to withstand the force or stress of the tubular 20 under axial tension. The retention device 21, 22 can have portions with other shapes in which the portions do not extend in an inward-radial direction with respect to the drill pipe 8 (i.e., with respect to the inner diameter of the drill pipe at the retention device). The advantage of not extending radially inward is that the thickness of the wall of the bore for accepting the tubular does not have to be reduced. This can be especially advantageous in that this bore may be gun drilled with tolerances that may be difficult to maintain during the drilling process. It can be appreciated that an outer diameter of the retention device 21, 22 where the retention device meets the end face of the tubular 20 may be the same as the outer diameter of the tubular 20 as illustrated in FIG. 3. Having the same outer diameters where the retention device meets the tubular avoids having the need to reduce the bore wall thickness at the interior of the drill pipe such as if the tubular diameter was required to be increased or stepped outwards towards an end in order to secure the tubular in axial tension. The increase in diameter would require a decrease in the bore wall thickness at the interior of the drill pipe, and may jeopardize the integrity of the bore containing the tubular.

Referring to FIG. 3, the arms to the T-shaped portion 40 are disposed in a cavity 30. The cavity 30 in one or more embodiments may be form-fit to the T-shaped portion 40. The cavity 30 enables the outer top surface of the T-shape to be flush with the bottom of the recess for accepting the cooperative signal coupler. The retention device 21, 22 is hollow allowing for the transmission line 5 to pass through and/or coupler connections to be made within the retention device. It can be appreciated that the arms of the T-shape may be curved with a radius that conforms to the radius of the recess for the signal coupler.

Figure 5:
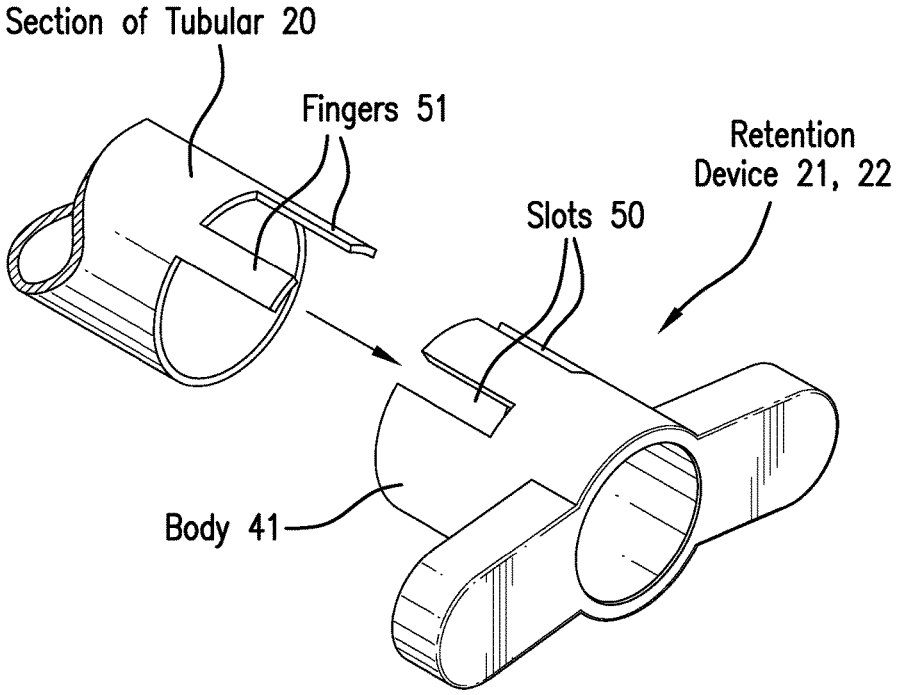
FIG. 5 depicts aspects of a retention device having a plurality of slots configured to interlock with cooperative slots in the tubular.

FIG. 5 illustrates the T-shaped retention device 21, 22 having a plurality of slots 50 in a body 41 in a three-dimensional view. The plurality of slots 50 are configured to interlock with a plurality of cooperative fingers 51 in the tubular 20. One advantage of the slot and finger arrangement is that it provides a greater contact or surface area upon which the retention device 21, 22 may be welded to the tubular 20, thereby providing a greater attachment strength.

Figure 6:
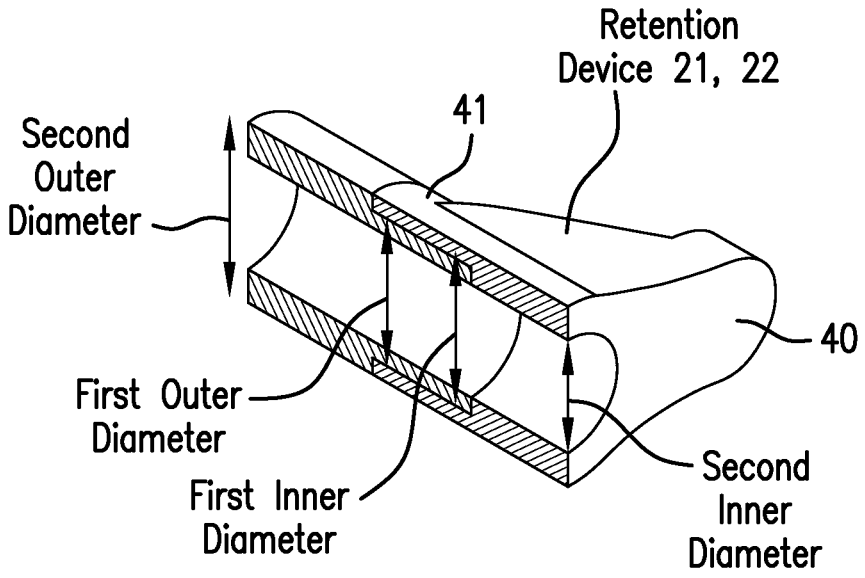
FIG. 6 depicts aspects of a tubular having a reduced outer diameter at an end that is configured to mate with an inner diameter at an end of a retention device.
Figure 7A:
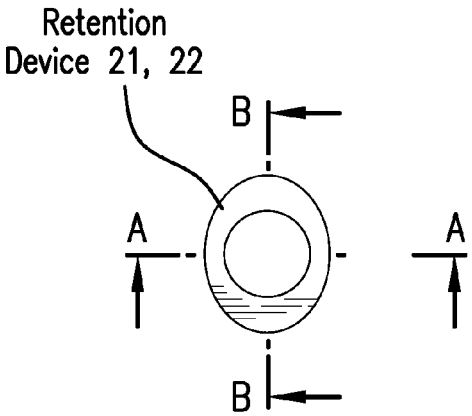
FIG. 7A-7D, collectively referred to as FIG. 7, depicts aspects of a retention device having an oval-shape.
Figure 7B:
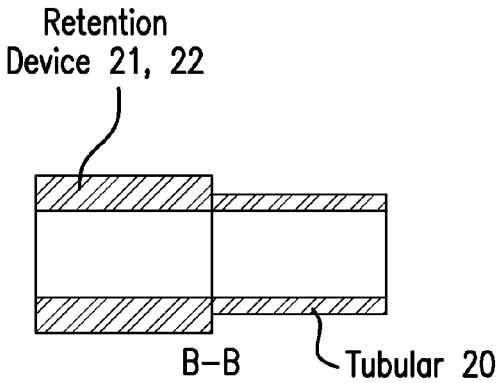
Figure 7C:
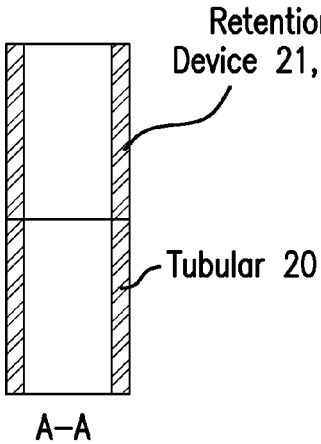
Figure 7D:
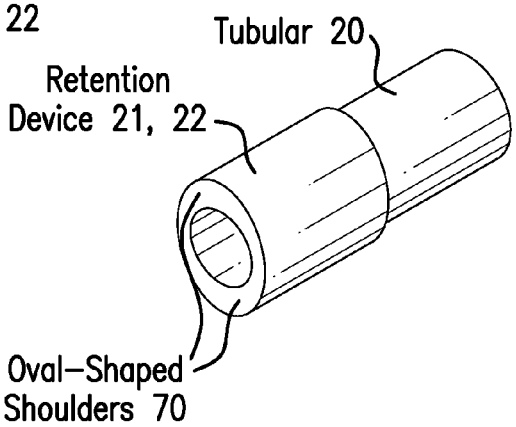

FIG. 6 illustrates another embodiment for securing the retention device 21, 22 to the tubular 20 in a three-dimensional view. In the embodiment of FIG. 6, the tubular 20 has a first outer diameter at an end face and a second outer diameter away from the end face. The retention device 21, 22 has a first inner diameter that is slightly greater than the first outer diameter in order to accept the end of the tubular 20 and a second inner diameter that is the same as the inner diameter or the tubular 20. The end portion of the tubular 20 with the first outer diameter is configured to be inserted into an end of the retention device 21, 22 until the body 41 contacts the second outer diameter. The double outer diameter configuration of the tubular 20 and the double inner diameter configuration of the retention device 21, 22 provides a greater contact surface upon which the retention device 21, 22 may be welded to the tubular 20, thereby providing a greater attachment strength.

FIG. 7 illustrates another embodiment of the retention device 21, 22 in several views. In the embodiment of FIG. 7, shoulders 70 of the retention device 21, 22 are oval-shaped where the long dimension (i.e. along B-B line) of the oval is perpendicular to a radius or diameter line of the drill pipe. In this embodiment, the shoulders 70 extend in a non-inward direction with respect to the drill pipe. Further in this embodiment, the short dimension (i.e., along the A-A line) is equal to the outer diameter of the tubular 20. In the embodiment illustrated in FIG. 7C, the retention device 21, 22 does not overlap the tubular 20.

While the tubular 20 is illustrated as being straight from the box end 23 to the pin end 24 of the drill pipe 8 in FIG. 2, it can be appreciated that the tubular can be deviated. The tubular may be deviated using restraining devices (not shown) that are configured to restrain the tubular 20 radially and yet allow the axial tension to be conveyed axially. Alternatively, the bore in the drill pipe 8 for accepting the tubular 20 may be deviated with respect to the center line of the drill pipe. In yet another embodiment, the tubular at the box end is at a different tool face than the tubular at the pin end where the tool face is the angle about the centerline of the drill pipe in an area perpendicular to the center line of the drill pipe.

Figure 8:
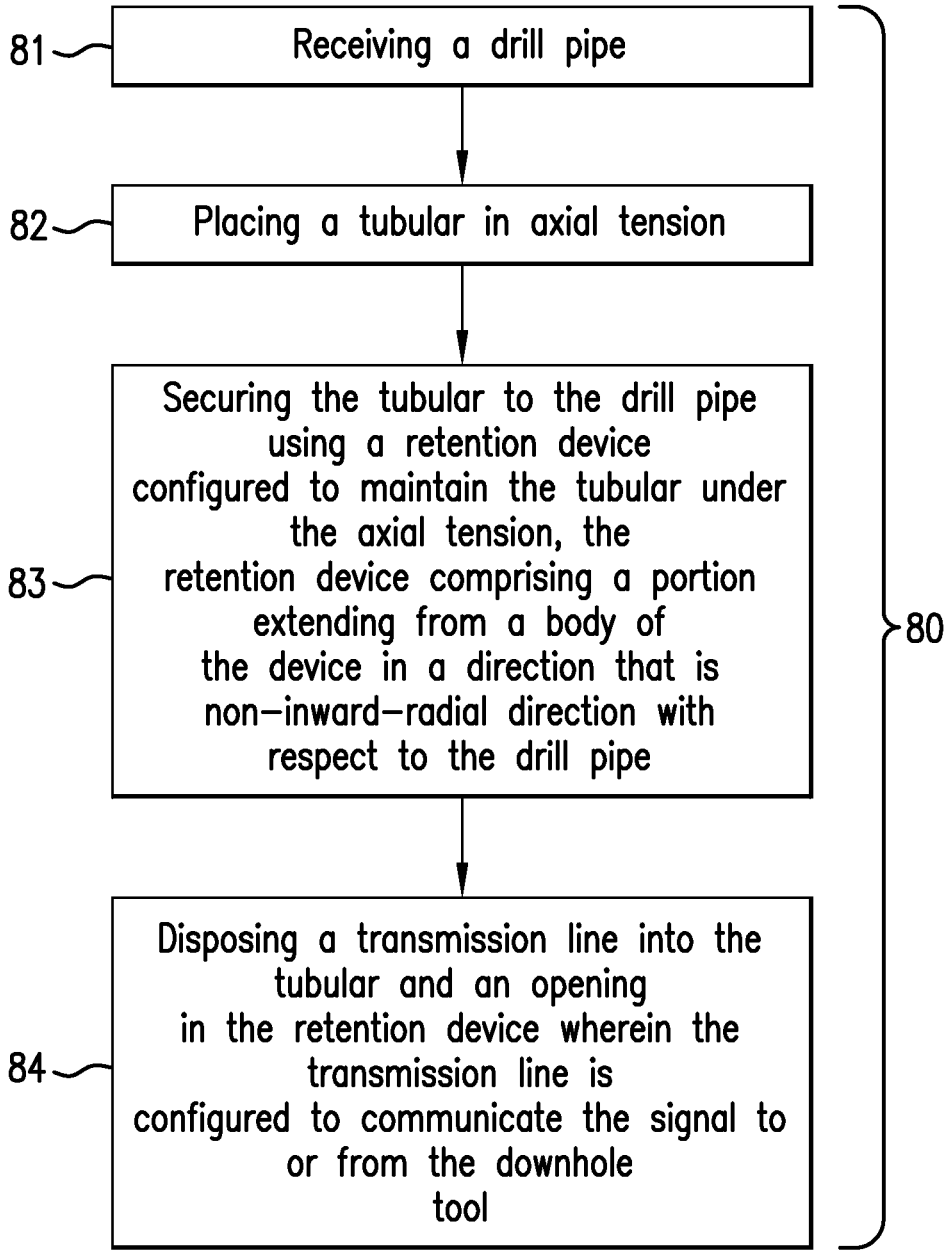
FIG. 8 is a flow chart for a method for building an apparatus for communicating a signal to or from a downhole tool.

FIG. 8 is a flow chart for a method 80 for building an apparatus for communicating a signal to or from a downhole tool. Block 81 calls for receiving a drill pipe. Block 82 calls for placing a tubular in axial tension. In one or more embodiments, the axial tension occurs at least with the drill pipe not under axial tension. Block 83 calls for securing the tubular to the drill pipe using a retention device configured to maintain the tubular under the axial tension. The retention device includes a portion extending from a body of the device in a direction that is non-inward-radial with respect to the drill pipe. In one or more embodiments, after one end of the tubular is secured to a first retention device, the other end is stretched using a gripper device that grips the end of the tubular. When the tubular is stretched, the first retention device engages the drill pipe stopping movement of the end of the tubular enabling the tubular to be stretched. After the tubular is stretched, the second retention device can be secured to that end. When the gripper device is released, the tubular will retract back into the drill pipe until the second retention device engages the drill pipe keeping the tubular in axial tension. The axial tension may be maintained even when the drill pipe is not under axial tension. In one or more embodiments, the retention device is secured to the end face of the tubular by applying a weld such as a butt weld. In one or more embodiments, the outer diameter of the retention device where it meets the end face of the tubular is the same as the outer diameter of the tubular. In one or more embodiments, the retention device has a plurality of slots or a double inner diameter to provide increased surface area for securing the retention device to the tubular. It can be appreciated that securing the retention device to the tubular using a weld provides for a seal that prevents fluids from entering the tubular and interfering with the transmission line. Block 84 calls for disposing a transmission line into the tubular where the transmission line is configured to transmit (i.e., communicate) a signal to or from the downhole tool.

Figure 9:
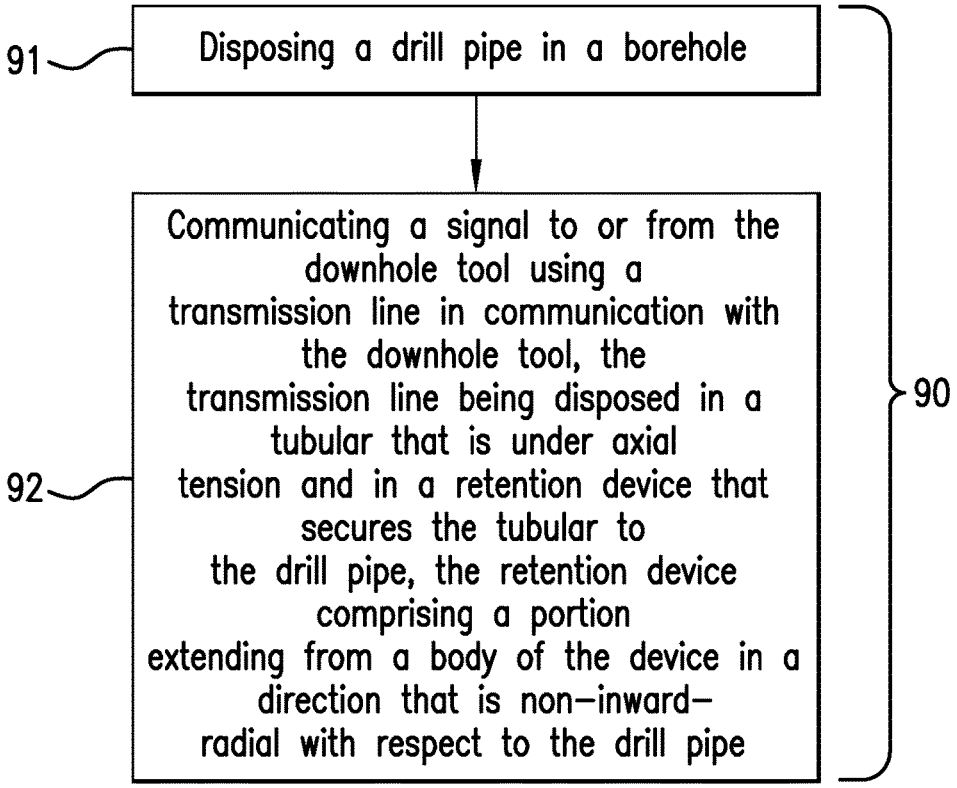
FIG. 9 is a flow chart for a method for communicating a signal to or from a downhole tool.

FIG. 9 is a flow chart for a method 90 for communicating a signal to or from a downhole tool. Block 91 calls for disposing a drill pipe in a borehole. Block 92 calls for communicating the signal to or from the downhole tool using a transmission line in communication with the downhole tool. The transmission line is disposed in a tubular that is under axial tension and in a retention device that secures the tubular to the drill pipe. The retention device includes a portion extending from a body of the device in a direction that is non-inward-radial with respect to the drill pipe. The method 90 may also include transmitting the signal between each of the drill pipes in the drill string using cooperative signal couplers.

In support of the teachings herein, various analysis components may be used, including a digital and/or an analog system. For example, the downhole tools 10, the downhole electronics 11, or the computer processing system 12 may include digital and/or analog systems. The system may have components such as a processor, storage media, memory, input, output, communications link (wired or optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), magnet, electromagnet, sensor, electrode, transmitter, receiver, transceiver, antenna, controller, optical unit, signal repeater, amplifier, connector, splice, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" and the like are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements.

The flow diagrams depicted herein are just examples. There may be many variations to these diagrams or the steps (or operations) described therein without departing from the spirit of the invention. For instance, the steps may be performed in a differing order, or steps may be added, deleted or modified. All of these variations are considered a part of the claimed invention.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus for communicating a signal to or from a downhole tool, the apparatus comprising:

a drill pipe configured to be rotated to drill a borehole;

a tubular under axial tension and secured in the drill pipe;

a retention device comprising a body and an arm extending from the body as one integral piece, the retention device being secured to the tubular and configured to maintain the tubular under the axial tension by having the arm configured to press directly against the drill pipe in order to maintain the tubular under the axial tension; and a transmission line disposed in the tubular and in an opening of the retention device and in communication with the downhole tool;

wherein an outer diameter of the retention device and an outer diameter of the tubular are the same where the retention device meets the tubular.

2. The apparatus according to claim 1, wherein a first dimension of the arm in a radial direction of the drill pipe is less than a second dimension of the arm in a circumferential direction of the drill pipe.

3. The apparatus according to claim 2, wherein the retention device is T-shaped.

4. The apparatus according to claim 2, wherein the arm is oval-shaped.

5. The apparatus according to claim 1, wherein the arm is disposed in a cavity of the drill string, the cavity being form-fit to the arm.

6. The apparatus according to claim 5, wherein the cavity is in a recess of a shoulder of the drill string, the recess being configured to accept a signal coupler configured to communicate signals with an adjacent signal coupler disposed in an adjacent drill pipe.

7. The apparatus according to claim 1, wherein the retention device is secured to an end face of the drill pipe.

8. The apparatus according to claim 1, wherein the tubular is disposed in a bore in the drill pipe.

9. The apparatus according to claim 1, wherein the tubular is unsupported for a range of distances in between two ends of the drill pipe.

10. The apparatus according to claim 1, wherein the axial tension occurs at least with the drill pipe not under axial tension.

11. The apparatus according to claim 1, wherein the retention device comprises a first retention device secured to a first end of the tubular and a second retention device secured to a second end of the tubular.

12. The apparatus according to claim 1, wherein the transmission line is configured to communicate at least one of electrical signals, electromagnetic signals, and optical signals.

13. An apparatus for communicating a signal to or from a downhole tool, the apparatus comprising:

a drill pipe configured to be rotated to drill a borehole;

a tubular under axial tension and secured in the drill pipe;

a retention device comprising a body and an arm extending from the body as one integral piece, the retention device being secured to the tubular and configured to maintain the tubular under the axial tension by having the arm configured to press directly against the drill pipe in order to maintain the tubular under the axial tension; and a transmission line disposed in the tubular and in an opening of the retention device and in communication with the downhole tool;

wherein the retention device is sealed to an end of the tubular by a butt weld.

14. An apparatus for communicating a signal to or from a downhole tool, the apparatus comprising:

a drill pipe configured to be rotated to drill a borehole;

a tubular under axial tension and secured in the drill pipe;

a retention device comprising a body and an arm extending from the body as one integral piece, the retention device being secured to the tubular and configured to maintain the tubular under the axial tension by having the arm configured to press directly against the drill pipe in order to maintain the tubular under the axial tension; and a transmission line disposed in the tubular and in an opening of the retention device and in communication with the downhole tool;

wherein the retention device and the tubular do not overlap.

15. An apparatus for communicating a signal to or from a downhole tool, the apparatus comprising:

a drill pipe configured to be rotated to drill a borehole;

a tubular under axial tension and secured in the drill pipe;

a retention device comprising a body and an arm extending from the body as one integral piece, the retention device being secured to the tubular and configured to maintain the tubular under the axial tension by having the arm configured to press directly against the drill pipe in order to maintain the tubular under the axial tension; and a transmission line disposed in the tubular and in an opening of the retention device and in communication with the downhole tool;

wherein the retention device comprises one or more slots at an end and an end of the tubular comprises one or more cooperative fingers configured to interlock with the one or more slots of the retention device.

16. An apparatus for communicating a signal to or from a downhole tool, the apparatus comprising:

a drill pipe configured to be rotated to drill a borehole;

a tubular under axial tension and secured in the drill pipe;

a retention device comprising a body and an arm extending from the body as one integral piece, the retention device being secured to the tubular and configured to maintain the tubular under the axial tension by having the arm configured to press directly against the drill pipe in order to maintain the tubular under the axial tension; and a transmission line disposed in the tubular and in an opening of the retention device and in communication with the downhole tool;

wherein the tubular comprises a first outer diameter at an end face and a second outer diameter away from the end face, the second outer diameter being greater than the first outer diameter, and the opening in the retention device comprises an inner diameter configured to accept the first outer diameter of the tubular but not the second outer diameter.

* * * * *